US007626567B2

(12) United States Patent
Aoki

(10) Patent No.: US 7,626,567 B2
(45) Date of Patent: Dec. 1, 2009

(54) ELECTRO-OPTIC DEVICE, METHOD FOR DRIVING THE SAME, AND ELECTRONIC DEVICE

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 639 days.

(21) Appl. No.: 11/591,149

(22) Filed: Nov. 1, 2006

(65) Prior Publication Data

US 2007/0097766 A1 May 3, 2007

(30) Foreign Application Priority Data

Nov. 2, 2005 (JP) ..... 2005-319166
Jul. 25, 2006 (JP) ..... 2006-201660

(51) Int. Cl.
*G09G 3/36* (2006.01)

(52) U.S. Cl. ..... 345/87; 345/98

(58) Field of Classification Search ..... 345/87–104
See application file for complete search history.

(56) References Cited

U.S. PATENT DOCUMENTS 6,483,494 B1 * 11/2002 Liaw et al. ..... 345/92
6,549,186 B1 * 4/2003 Kwon ..... 345/95
6,580,486 B1 * 6/2003 Sekine ..... 349/139
6,731,266 B1 * 5/2004 Jung ..... 345/103
6,924,784 B1 * 8/2005 Yeo et al. ..... 345/98
7,215,311 B2 * 5/2007 Kim ..... 345/98
7,310,079 B2 * 12/2007 Chen et al. ..... 345/87
7,369,187 B2 * 5/2008 Park ..... 349/38
7,403,185 B2 * 7/2008 Song et al. ..... 345/100
2005/0280613 A1 * 12/2005 Takei et al. ..... 345/76

FOREIGN PATENT DOCUMENTS

JP A-10-171421 6/1998
JP A-2000-112437 4/2000

* cited by examiner

*Primary Examiner*—Bipin Shalwala
*Assistant Examiner*—Steven E Holton
(74) *Attorney, Agent, or Firm*—AdvantEdge Law Group, LLC

(57) ABSTRACT

An electro-optic device comprising, a plurality of pixels corresponding to a plurality of scanning lines and a plurality of data lines a scanning-line drive circuit that selects the scanning lines in a predetermined order a block selection circuit that sequentially selects a block including m columns of data lines (m is an integer equal to or larger than 2 and smaller than the total number of the data lines); m image signal lines to which data signals are supplied and to which precharge signals of a predetermined voltage are supplied before the block is selected, the data signals each having a voltage corresponding to the gray-scale level of a pixel corresponding to a selected scanning line and a data line in a selected block; a sampling switch provided for each data line, wherein when the data signals are supplied to the m image signal lines, m sampling switches corresponding to the data lines in the block selected by the block selection circuit become conducting to sample the data signals; when the precharge signals are supplied to the m image signal lines, the sampling switches become conducting according to a predetermined control signal to sample the precharge signal on the data lines before the sampling switches sample the data signals; and short-circuiting switches that become conducting according to a predetermined second control signal and short-circuit at least m data lines in the block, after the percentage signals are sampled to the data lines by the precharge switch before the data signals are sampled to the data lines.

7 Claims, 8 Drawing Sheets

ELECTRO-OPTIC DEVICE, METHOD FOR DRIVING THE SAME, AND ELECTRONIC DEVICE

BACKGROUND

1. Technical Field

The present invention relates to a technique of preventing display degradation when both phase expansion driving and video precharge are used.

2. Related Art

In recent years, projectors that form reduced images using an electro-optic panel such as a liquid crystal panel and project the reduced images on an enlarged scale through an optical system have been coming into widespread use. The projectors have no function of forming images by themselves, and receive image data (or image signals) from a host device such as a personal computer or a TV tuner. The image data designates the gray level (brightness) of each of pixels supplied in the form of pixel matrix scanned vertically and horizontally. It is therefore appropriate to accordingly drive the display panels for use in projectors. Accordingly, the display panels for projectors are generally driven by a dot sequential system in which scanning lines are selected in a predetermined order on a line-by-line basis, and in which data lines are selected one by one during the period of time that one scanning line is selected (a horizontal scanning period), and a data signal that is converted from image data so as to be suitable for driving liquid crystal is supplied to the selected data line.

High-definition display images, such as those shown in high-definition televisions, have been recently becoming more common place. The high-definition can be achieved by increasing the number of scanning lines and the number of columns of data lines. However, the frame frequency is fixed, so that one horizontal scanning period is decreased by an increase in the number of scanning lines. In addition, in the dot sequential system, the time suitable to select data lines is also reduced by an increase in the number of columns of data lines. Accordingly, the dot sequential system cannot provide sufficient time for supplying data signals to data lines to realize high definition image display with the advance of high definition, leading to insufficient writing to pixels. Thus, a phase expansion driving system was devised to solve the problem of insufficient writing (refer to JP-A-2000-112437).

This phase expansion driving system is a system in which data lines are divided into blocks every predetermined number of columns, for example, every six columns, and the blocks are selected in a predetermined order one by one in one horizontal scanning period, while data signals supplied via six image signal lines and extended to six times on time base are sampled and supplied to six columns of data lines in the selected block.

Since the data lines are formed close to each other on a substrate made of glass or quartz, parasitic capacitors are formed on the data lines. Accordingly, when data signals are supplied, the voltages of the data signals are held by the parasitic capacitors. Since the voltage of a data signal depends on display content, when a voltage according to the display content is sampled for a data line to write data into the line, the sampled voltage is held until writing to the next line. Accordingly, at the writing to the next line, the initial voltage immediately before the data signal is sampled for the data line might become different between the data lines.

In this case, even if the same voltage is sampled to have the same pixel gray level, the sampled voltage will become different because of the difference in initial voltage level. In order to prevent this from occurring, a technique of precharging all data lines with a predetermined voltage immediately before data signals are sent to data lines has been developed (refer to JP-A-10-171421).

Another technique of precharging is termed video precharge in which precharge signals of the same voltage are supplied to six image signal lines, and the precharge signals are sampled for all data lines to thereby precharge all the data lines.

However, in the technique of video precharge, although precharge signals of the same voltage are applied to all image signal lines, the voltages precharged to the data lines have slight differences, thus resulting in degradation in display quality due to the differences.

SUMMARY

An advantage of the invention is that it provides an electro-optic device using both phase expansion and video precharge and capable of precharging data lines with substantially the same voltage, a method for driving the same, and an electronic device.

According to an aspect of the invention, there is provided an electro-optic device including: a plurality of pixels corresponding to a plurality of scanning lines and a plurality of data lines a scanning-line drive circuit that selects the scanning lines in a predetermined order a block selection circuit that sequentially selects a block including m columns of data lines (m is an integer equal to or larger than 2 and smaller than the total number of the data lines); m image signal lines to which data signals are supplied and to which precharge signals of a predetermined voltage are supplied before the block is selected, the data signals each having a voltage corresponding to the gray-scale level of a pixel corresponding to a selected scanning line and a data line in a selected block; a sampling switch provided for each data line, wherein when the data signals are supplied to the m image signal lines, m sampling switches corresponding to the data lines in the block selected by the block selection circuit become conducting to sample the data signals; when the precharge signals are supplied to the m image signal lines, the sampling switches become conducting according to a predetermined control signal to sample the precharge signal on the data lines before the sampling switches sample the data signals; and short-circuiting switches that become conducting according to a predetermined second control signal and short-circuit at least m data lines in the block, after the precharge signals are sampled to the data lines by the precharge switch before the data signals are sampled to the data lines.

It is preferable that the short-circuiting switch short-circuit not only the m data lines in the same block, but also all the data lines. It is preferable that the sampling switch be disposed at one end of the data line, and the short-circuiting switch be disposed at the other end of the data line. It is preferable that the period during which the short-circuiting switch is conducting according to the second control signal be shorter than the period during which the sampling switch is conducting according to the first control signal. It is preferable that the timing at which the short-circuiting switch is made to become conducting according to the second control signal be later than the timing at which the sampling switch is made to stop being conducting according to the first control signal.

According to other aspects of the invention, a method for driving the electro-optic device and an electronic device including the electro-optic device can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
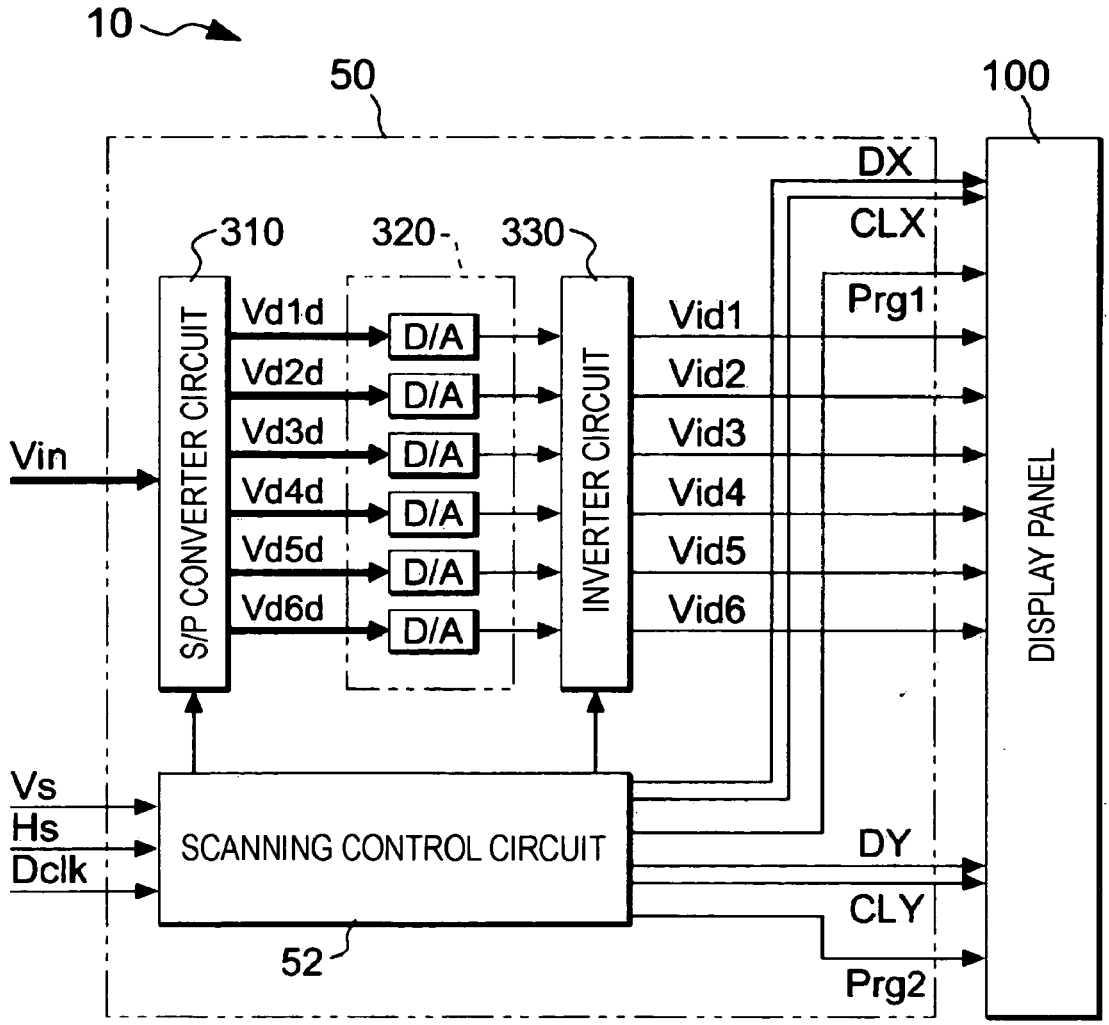
FIG. 1 is a block diagram showing the overall structure of an electro-optic device according to an embodiment of the invention.

An embodiment of the invention will be described hereinbelow with reference to the attached drawings. FIG. 1 is a block diagram showing the overall structure of an electro-optic device, indicated by numeral 10, according to the present embodiment of the invention.

As shown in this diagram, the electro-optic device 10 is broadly divided into a processing circuit 50 and a display panel 100. The processing circuit 50 is a circuit module formed on a printed board, and is connected to the display panel 100 with a flexible printed circuit (FPC) board etc.

The processing circuit 50 includes a scanning control circuit 52, an S/P converter circuit 310, a D/A converter circuit group 320, and an inverter circuit 330. The S/P converter circuit 310 distributes digital image data Vin sent from a host device (not shown) to six channels in synchronization with a vertical scanning signal Vs, a horizontal scanning signal Hs, and a dot clock signal Dclk, and extends them to six times on time base (expands in phase or converts from serial to parallel), and outputs them as image data Vd1d to Vd6d.

The image data Vin is for designating the gray level (lightness) of each pixel. During retrace period, the image data Vin does not designate the lightness of the pixels of the display panel 100; instead, data designating the gray level of the pixel (black) as black is supplied as dummy data. For convenience of description, the image data Vd1d to Vd6d are referred to as channels 1 to 6.

The D/A converter circuit group 320 is a set of D/A converter circuits provided for the channels, which converts the image data Vd1d to Vd6d to analog signals of voltages corresponding to the gray level.

The inverter circuit 330 turns the polarity of the analog signals positively or negatively into data signals Vid1 to Vid6 and supplies them to six image signal lines connected to the display panel 100.

The polarity is inverted (a) every scanning line, (b) every data line, (c) every pixel, (d) every frame, and so on. In this embodiment, the polarity is inverted for each scanning line. However, the invention is not limited thereto.

Figure 5:
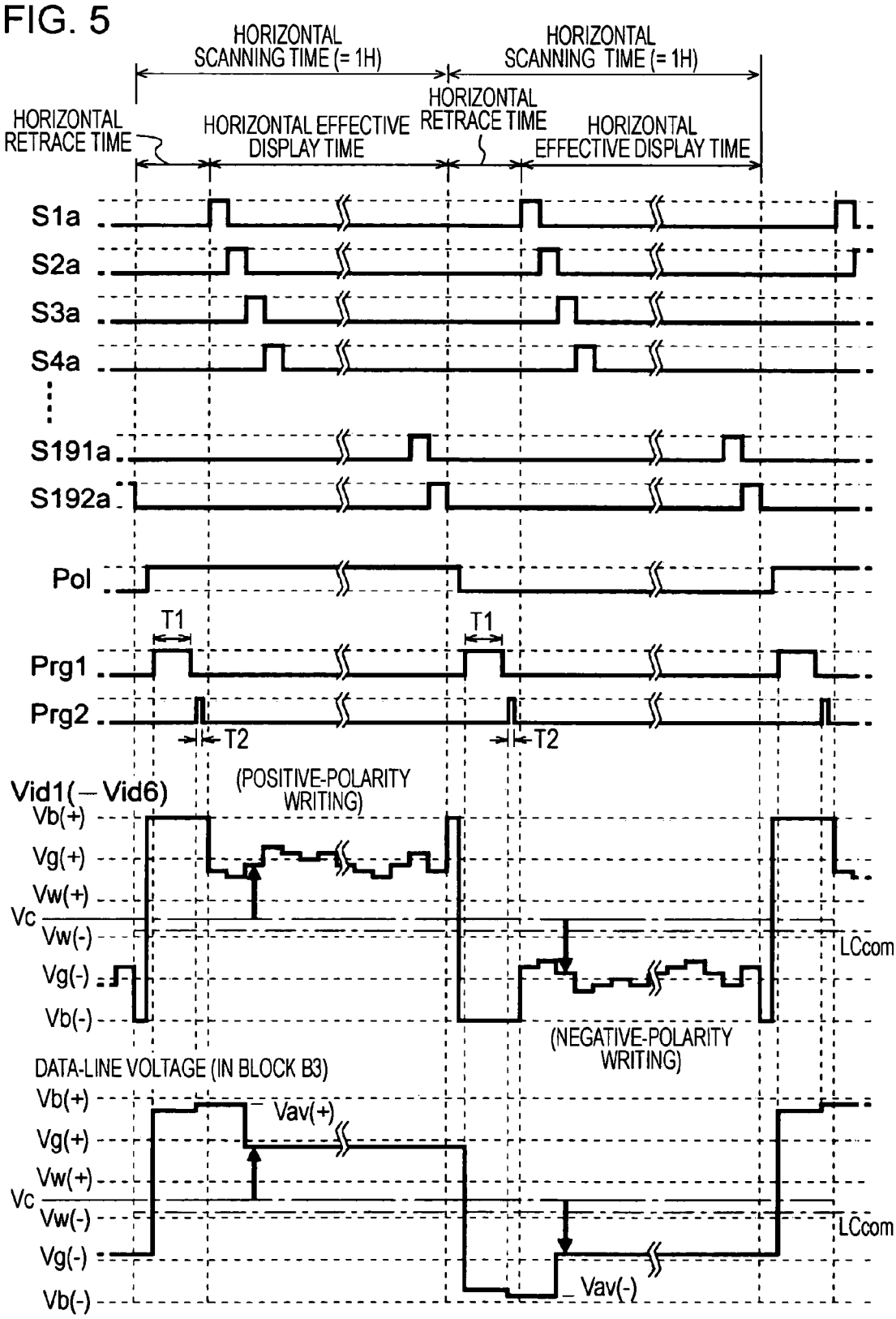
FIG. 5 is a diagram for describing the precharge operation of the electro-optic device.

The voltage Vc is half of the amplitude of the data signals Vid1 to Vid6, as shown in FIG. 5. In this embodiment, the polarity of the data signals Vid1 to Vid6 higher than the amplitude center voltage Vc is referred to as a positive polarity, and that of signals lower than the voltage Vc is referred to as a negative polarity. In this embodiment, after the image data Vin is converted from serial to parallel, it is converted to an analog signal. It is needless to say that analog conversion may be made before serial to parallel conversion.

Figure 2:
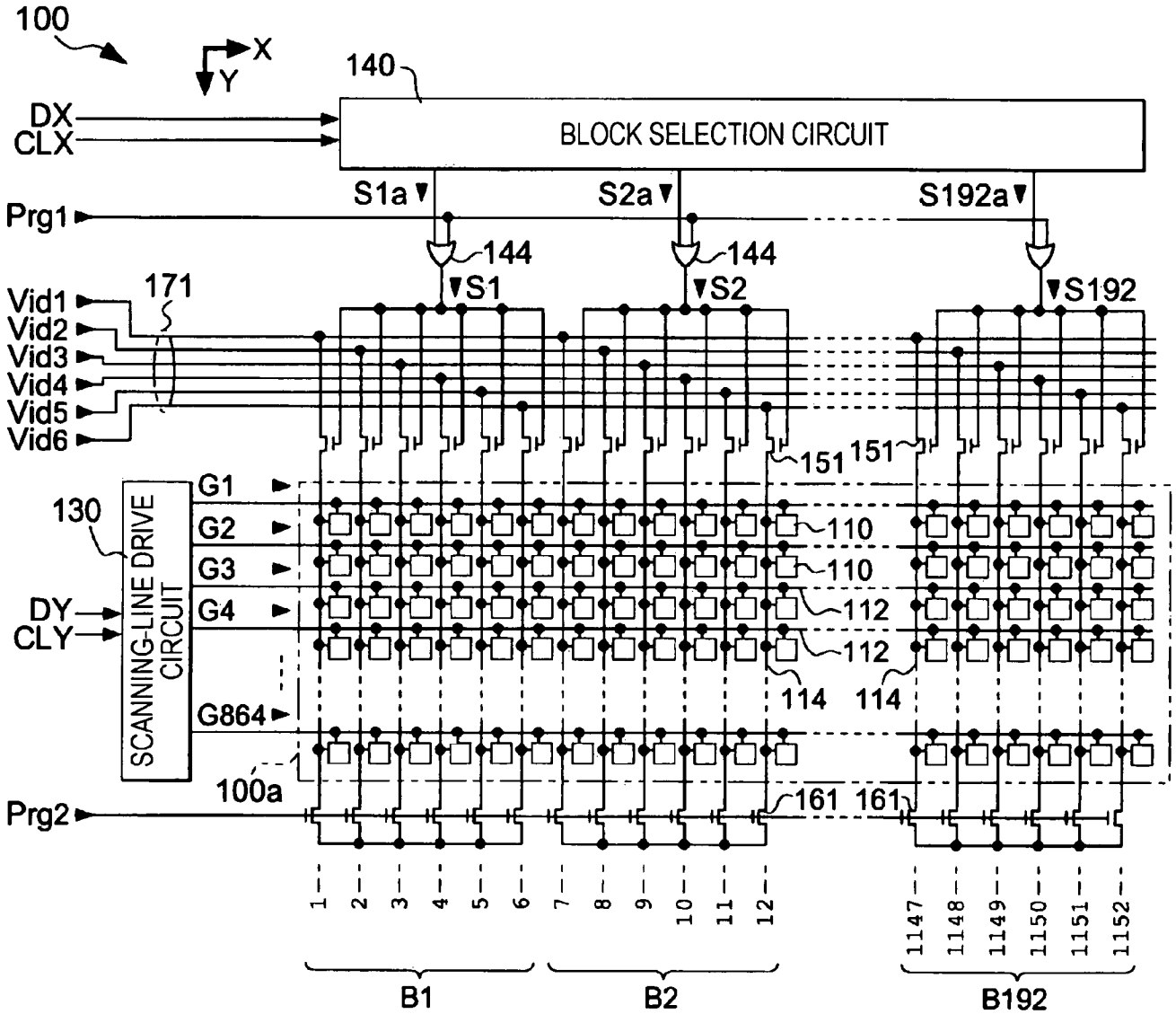
FIG. 2 is a block diagram showing the electrical structure of a display panel of the electro-optic device.

Here, the structure of the display panel 100 on which images are formed by electro-optic change will be described for convenience. The display panel 100 has a structure in which a device substrate having data lines, scanning lines, TFTs, and pixel electrodes and an opposing substrate having common electrodes are bonded so that electrode-forming faces are opposed to each other with a certain spacing, and in which the spacing is airtightly filled with liquid crystal. FIG. 2 is a block diagram showing the electrical structure of the display panel 100; and FIG. 3 is a diagram showing the structure of the pixels on the display panel 100.

As shown in FIG. 2, the display panel 100 has 864 scanning lines 112 extending in the X (horizontal) direction, and 1,152 (=192×6) columns of data lines 114 extending in the Y (vertical) direction. Pixels 110 are disposed on the intersections between the scanning lines 112 and the data lines 114. The pixels 110 are thus arrayed in an 864-by-1152 matrix. The region in which the pixels 110 are arrayed is a pixel region 100*a*.

In this embodiment, the 1,152 columns of data lines 114 are divided into blocks every six columns. For the convenience of description, the 1st to 192nd blocks from the left are expressed as B1 to B192, respectively.

Figure 3:
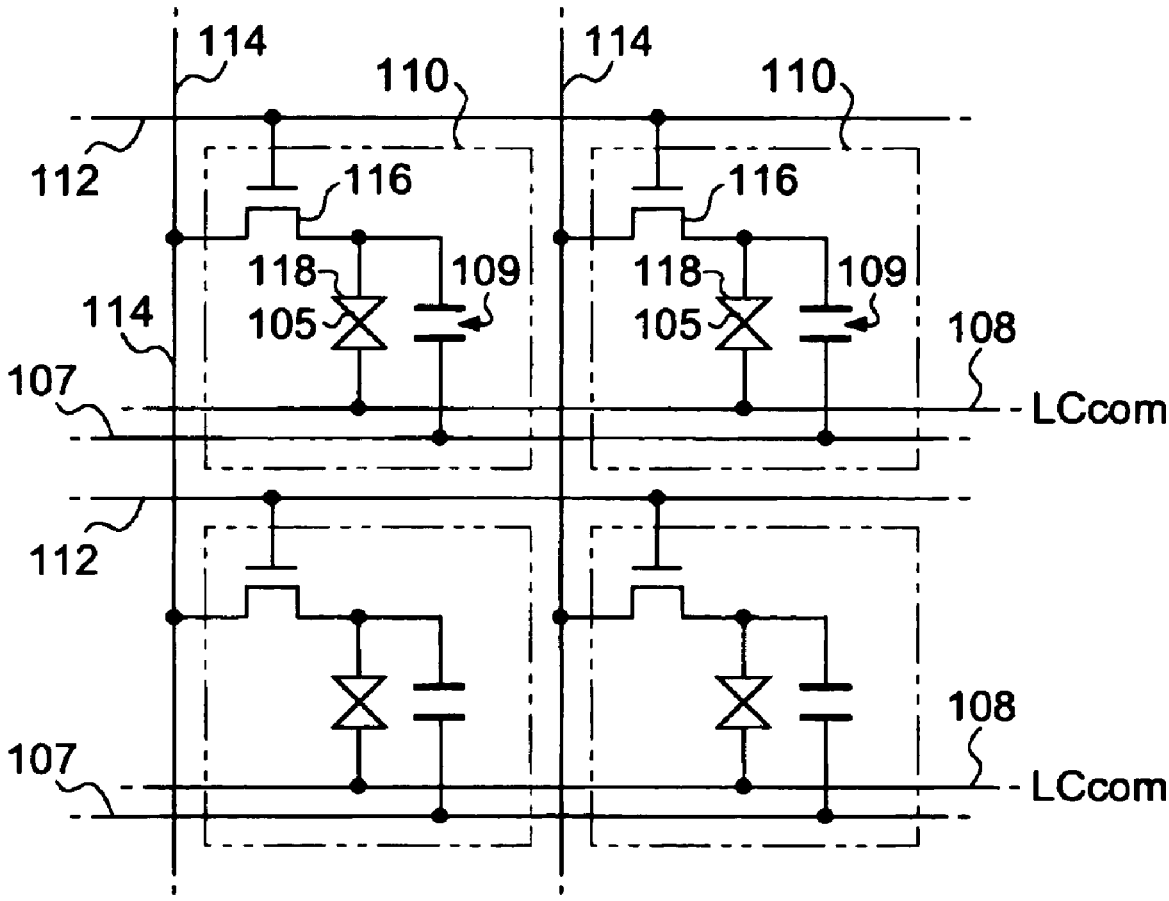
FIG. 3 is a diagram showing the structure of the pixels on the display panel.

Referring to FIG. 3, the detailed structure of the pixels 110 will be described as follows: the source of an n-channel thin-film transistor (hereinafter, simply referred to as a TFT) 116 is connected to the data line 114; the drain is connected to a pixel electrode 118, and the gate is connected to the scanning line 112.

A common electrode 108 is opposed to the pixel electrode 118 in common to all the pixels, and is maintained at a temporally constant voltage LCcom. A liquid-crystal layer 105 is sandwiched between the pixel electrode 118 and the common electrode 108. Thus, a liquid-crystal capacitor formed of the pixel electrode 118, the common electrode 108, and the liquid-crystal layer 105 is formed for each pixel. In this embodiment, the voltage LCcom applied to the common electrode 108 is set slightly lower than the amplitude center voltage Vc of the data signals.

Although not shown, the opposing faces of the substrates each have an alignment layer subjected to rubbing so that the longitudinal axes of the liquid-crystal molecules are continuously twisted at substantially 90 degrees between the substrates, while the back surfaces of the substrates each have a polarizer corresponding to the direction of the alignment.

The light passing between the pixel electrode 118 and the common electrode 108 is polarized to about 90 degrees along the twist of the liquid-crystal molecules if the effective voltage applied to the liquid-crystal capacitor is zero; the liquid-crystal molecules are inclined to the electric field as the effective voltage increases and, as a result, the polarity disappears. Therefore, when polarizers whose polarization axes intersect each other are disposed in the direction of the alignment in a transmissive LCD, with the effective voltage close to zero, the light transmission becomes the maximum to display white; with an increase in the effective voltage, the amount of transmission light decreases to reach the minimum transmission, thus giving a black display (a normally white mode). A storage capacitor 109 is formed for each pixel to reduce the influence of charge leakage from the liquid-crystal capacitor via the TFT 116. One end of the storage capacitor 109 is connected to the pixel electrode 118 (the drain of the TFT 116), while the other end is connected to a capacitor line 107 in common to all the pixels; for example, it is grounded to a lower potential Vss of the power source in common.

Figure 4:
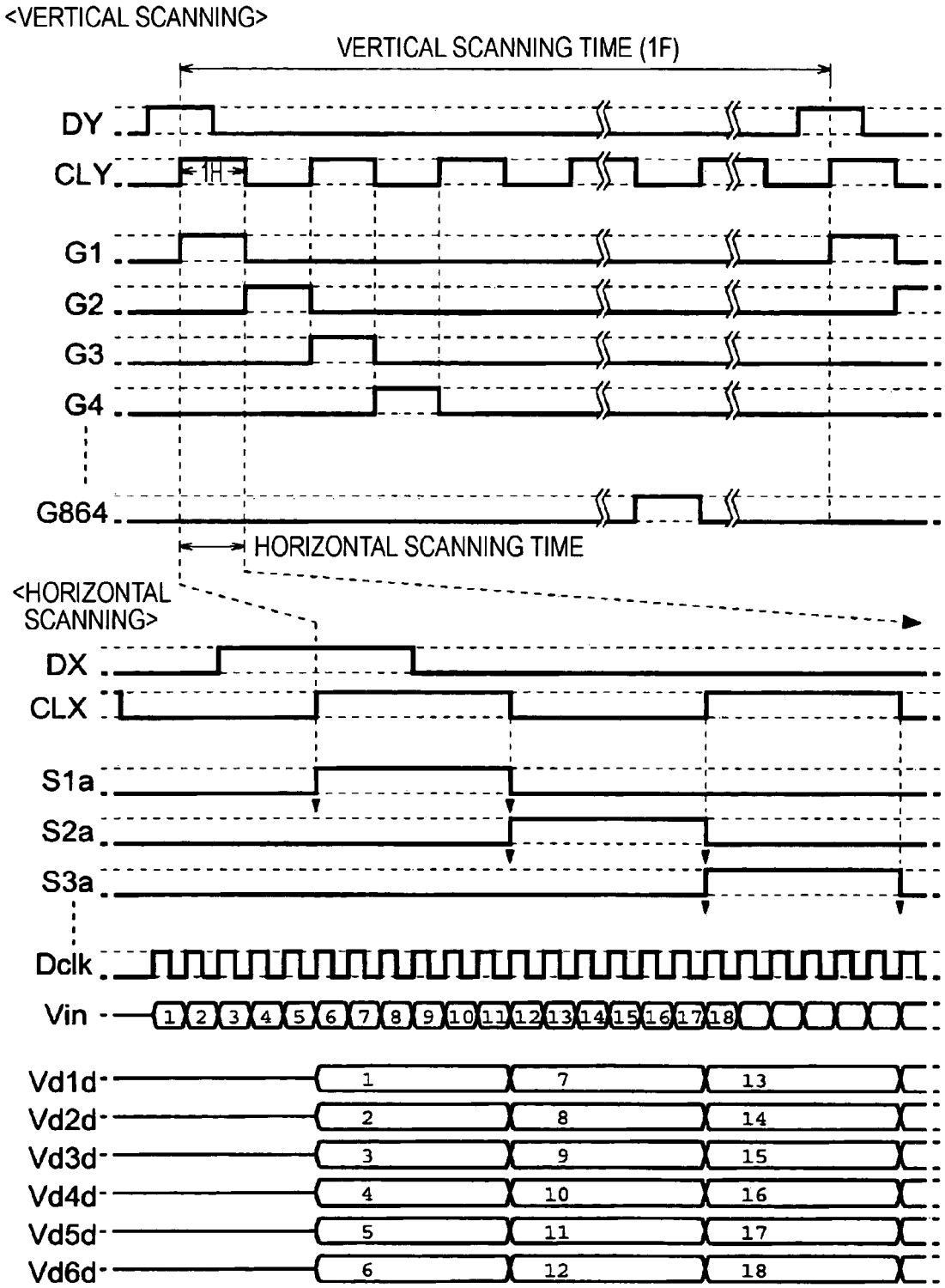
FIG. 4 is a diagram for describing the vertical and horizontal scanning operation of the electro-optic device.

There are peripheral circuits including a scanning-line drive circuit 130 and a block selection circuit 140 around the pixel region 100*a*. Referring to FIG. 4, the scanning-line drive circuit 130 supplies scanning signals G1 to G864 to the first to 864th scanning lines 112, respectively.

Although the details of the scanning-line drive circuit 130 are omitted because it has no direct connection with the invention, it outputs a transfer start pulse DY which is supplied at the start of the vertical scanning period (1F) and having a pulse width of about half (level H (high)) of a clock signal CLY in such a manner as to shift every time the level of the clock signal CLY shifts (rises or falls) as scanning signals G1 to G864.

The block selection circuit 140 selects blocks B1 to B192 in sequence when any of the scanning signals are at level H, and shifts a transfer start pulse DX supplied at the start of one horizontal scanning period and having a pulse width of about half a clock signal CLX (level H) every time the level of the clock signal CLX with a duty ratio of 50% shift to output it as signals S1*a* to S192*a*.

The signals S1*a* to S192*a* from the block selection circuit 140 are supplied to one of the input terminals of each OR circuit 144. The other input terminal of the OR circuit 144 receives a first control signal Prg1 for controlling precharge in common, the signal Prg1 being supplied from the scanning control circuit 52 (see FIG. 1).

Let the ordinal number of the signals S1*a* to S192*a* supplied from the block selection circuit 140 be not specified but generally expressed as Sna, where n is an integer equal to or larger than 1 and equal to or smaller than 192. The OR circuit 144, which inputs the signal Sna to one of the input terminals, outputs the OR signal of the signal Sna and the first control signal Prg1 as a sampling signal Sn.

A TFT 151 functioning as a sampling switch is provided for each of the OR circuits 144, and the drain of the TFT 151 is connected to one end of a corresponding data line.

Here, the gates of six TFTs 151 corresponding to the data lines 114 in the same block receive a common sampling signal corresponding to the block. For example, the gates of six TFTs 151 corresponding to seventh- to $12^{th}$-column data lines 114 in block B2 receive a sampling signal S2 corresponding to the block B2 in common.

The sources of the TFTs 151 are connected to any of six image signal lines 171 to which the data signals Vid1 to Vid6 are supplied in the following way.

In the case of the TFT 151 whose drain is connected to one end of the data line 114 in the $j^{th}$ column from the left in FIG. 2, if the remainder of the division of j by 6 is 1, the source is connected to the image signal line 171 to which the signal Vid1 is supplied; similarly, the sources of the TFTs 151 whose drains are connected to the data lines 114 of which the remainders of division of j by 6 is 2, 3, 4, 5, and 0 are respectively connected to the signal lines 171 to which data signals Vid2 to Vid6 are supplied.

For example, the source of the TFT 151 whose drain is connected to the $11^{th}$-column data line 114 in FIG. 2 is connected to the image signal line 171 to which the data signal Vid5 is supplied because the remainder of division of 11 by 6 is 5.

Symbol j is for generally describing the data lines 114 without specifying the ordinal position, which is, in this embodiment, an integer that satisfies $1 \leqq j \leqq 1152$.

A TFT 161 functioning as a short-circuiting switch is disposed for each of the data lines 114, whose drain (or source) is connected to the other end of a corresponding data line. In this embodiment, the sources (or drains) of six TFTs 161 corresponding to data lines 114 in the same block are connected in common block by block. The gates of all the TFTs 161 receive a second control signal Prg2 from the scanning control circuit 52 in common.

Since the data lines are formed on a device substrate and adjacent to each other, a parasitic capacitor is formed between each adjacent pair of the data lines 114. Therefore, when both of the TFTs 151 and 161 are in nonconductive (off) state, the voltages sampled for the data lines 114 are held by the parasitic capacitors.

Referring back to FIG. 1, the scanning control circuit 52 generates the transfer start pulse DX and the clock signal CLX from the dot clock signal Dclk, the vertical scanning signal Vs, and the horizontal scanning signal Hs supplied from a host device to control the horizontal scanning by the block selection circuit 140, and generates a transfer start pulse DY and a clock signal CLY to control the vertical scanning by the scanning-line drive circuit 130. The scanning control circuit 52 outputs the first control signal Prg1 and the second control signal Prg2 to control precharge operation, to be described later. The scanning control circuit 52 also controls the phase expansion by the S/P converter circuit 310 in synchronization with horizontal scanning, and outputs a polarity indication signal Po1 to indicate the polarity for the inverter circuit 330. The polarity indication signal Po1 indicates positive polarity higher than the voltage Vc if of level H, while it indicates negative polarity lower than the voltage Vc if of level L.

In this embodiment, as has been described, since the polarity is inverted every scanning line (a), the polarity indication signal Po1 is inverted in logic level every time one scanning line is selected. Furthermore, during the same horizontal scanning period in continuous two vertical scanning periods, the logic level of the polarity indication signal Po1 is reversed by the AC driving of the capacitor of the liquid crystal (not shown).

The operation of the electro-optic device 10 according to the embodiment will be described.

Image data Vin is supplied from a host device to the pixels 110 in order, starting with the pixel in the first line and the first column to the pixel in the first line and the $1152^{th}$ column, the pixel in the second line and the first column to the pixel in the second line and the $1152^{th}$ column, the pixel in the third line and the first column to the pixel in the third line and the $1152^{th}$ column, and through the pixel in the $864^{th}$ line and the first column to the pixel in the $864^{th}$ line and the $1152^{th}$ column. The image data Vin is supplied to each pixel in synchronization with the dot clock signal Dclk, and subjected to phase expansion into the image data Vd1d to Vd6d by the S/P converter circuit 310 as shown in FIG. 4, and is further converted to data signals Vid1 to Vid6 with an analog voltage of a polarity designated by the polarity indication signal Po1. FIG. 4 shows the phase expansion process for image data Vin corresponding to pixels in the first line and first column.

Referring to FIG. 5, the operation during a horizontal effective display period in which the image data Vin is supplied to the pixels in the $i^{th}$ line, that is, pixels in the $i^{th}$ line and the first column to the pixels in the $i^{th}$ line and the $1152^{th}$ column, and data signals Vid1 to Vid6 corresponding thereto is output, and the preceding horizontal retrace period will be described. Symbol i is for generally describing the line, which is, in this embodiment, an integer that satisfies $1 \leqq j \leqq 864$.

During the horizontal retrace period, the polarity indication signal Po1 is inverted to the logic level of the written polarity in the horizontal effective display period directly after the horizontal retrace period. The image data Vin becomes dummy data that designates black for pixels during the horizontal retrace period. Accordingly, when the polarity indication signal Po1 changes from level L (low) to level H during the horizontal retrace period, the voltage of the data signals Vid1 to Vid6 changes from a voltage Vb(−) corresponding to black with a negative polarity to a voltage Vb(+) corresponding to black with a positive polarity; when the polarity indication signal Po1 changes from level H to level L during the horizontal retrace period, the voltage of the data signals Vid1 to Vid6 changes from a voltage Vb(+) to a voltage Vb(−) corresponding to black with a negative polarity. In this embodiment, the voltages Vb(+) and Vb(−) are used as precharge signals, or objective precharge voltages.

The relationship among the voltages in FIG. 5 will be described. Voltages Vb(+), Vw(+), and Vg(+) are positive-polarity voltages that make the pixels black with the lowest gray level, white with the highest gray level, and gray with halftone, respectively, when applied to the pixel electrodes 118. On the other hand, voltages Vb(−), Vw(−), and Vg(−) are negative-polarity voltages that make the pixels black, white, and gray, respectively, when applied to the pixel electrodes 118, which are symmetrical with the voltages Vb(+), Vw(+), and Vg(+) with reference to the voltage Vc.

Referring to FIG. 5, the logic signals such as sampling signals and polarity indication signals and the data signals which are analog signals have different voltage scales for convenience.

After the logical level of the polarity indication signal Po1 is inverted during the horizontal retrace period, the first control signal Prg1 is held at level H only during period T1.

With the first control signal Prg1 at level H, the output signals of the OR circuits 144 which input the first control signal Prg1 at each stage, namely, the sampling signals S1 to S192, become level H all at once to turn on all the TFTs 151. Therefore, when the polarity indication signal Po1 is inverted to level H during the horizontal retrace period, all the data lines 114 should be precharged to voltage Vb(+). However, actually, the image signal line 171 of the channel 1 passes under the wires of the image signal lines 171 of channels 2 to 6 into connection with the sources of the TFTs 151, while the image signal line 171 of the channel 6 is connected directly to the sources of the TFTs 151. Therefore, the lengths (resistances) from the image signal line 171 to the data line 114 are not equal among the channels 1 to 6. Moreover, the characteristics of the TFTs 151 are not completely the same but are slightly different. In particular, for the same block, the characteristics of the six TFTs 151 corresponding to the channels 1 to 6 are slightly different.

Accordingly, actually precharged voltages are slightly different among the data lines 114 corresponding to the channels 1 to 6 because of the difference in the wiring resistance and characteristics.

In this embodiment, after the first control signal Prg1 reaches level L during the horizontal retrace period, the second control signal Prg2 is held at level H during period T2, which is shorter than period T1.

Here, when the second control signal Prg2 reaches level H, all the TFTs 161 are turned on, so that the data lines 114 in the six columns in the same block are short-circuited. Accordingly, the voltages of the data lines 114 in the six columns become the average of the voltages precharged to the data lines 114 in the six columns, being leveled to the same voltage Vav(+). When the second control signal Prg2 reaches level L, the horizontal retrace period is finished and a horizontal effective display period is started.

During the horizontal effective display period, the image data Vin supplied in synchronization with horizontal scanning is firstly distributed to the six channels by the S/P converter circuit 310, and extended to six times on time base, and secondly converted to analog signals by the D/A converter circuit group 320, and thirdly, when the polarity indication signal Po1 is at level H, they are converted by the inverter circuit 330 to data signals Vid1 to Vid6 with positive polarity with reference to the voltage Vc.

Strictly speaking, since this embodiment employs six-phase expansion, the timing of starting to supply the first-column pixels of the image data supplied from an external device is five pixels ahead of the timing of starting to output the first to sixth-column data signals Vid1 to Vid6 (refer to FIG. 4). In this embodiment, the period during which the sampling signals S1 to S192 sequentially exclusively reach level H is assumed to be a horizontal effective display period for convenience of description.

When the sampling signal S1 reaches level H during a horizontal effective display period in which a scanning signal Gi reaches level H, the data signals Vid1 to Vid6 are sampled for the first to sixth data lines 114 in the six columns in the block B1 that is the first from the left in FIG. 2. With the scanning signal Gi at level H, all the TFTs 116 in the pixels 110 in the $i^{th}$ line are in the on state, so that the voltages of the data signals Vid1 to Vid6 sampled for the data lines 114 in the six columns are applied to the pixel electrodes 118 of the pixels 110 at the intersections between the scanning line 112 in the $i^{th}$ line from above in FIG. 2 and the data lines 114 in the six columns, respectively. Thereafter, when the sampling signal S2 reaches level H, then the voltages of the data signals Vid1 to Vid6 are sampled for the seventh- to $11^{th}$-column data lines 114 in the second block B2, and are applied to the pixel electrodes 118 at the intersections between the scanning line 112 in the $i^{th}$ line and the data lines 114 in the six columns, respectively.

Similarly, when the sampling signals S3 to S192 sequentially exclusively reach level H, the voltages of the data signals Vid1 to Vid6 are sampled for the data lines 114 in the six columns in the blocks B3 to B192 and are applied to the pixel electrodes 118 of pixels at the intersections between the scanning line 112 in the $i^{th}$ line and the selected data lines 114 in the six columns, respectively. Thus, writing to all the $i^{th}$-line pixels is completed. Thereafter, even if the scanning signal Gi reaches level L to turn off the TFTs 116, the written voltage is held by the liquid-crystal capacitors and the storage capacitors 109. The voltage of the data signals sampled for the data lines 114 is held by parasitic capacitors.

The operation for the horizontal retrace period and the horizontal effective display period in the subsequent $(i+1)^{th}$ line is substantially the same as that of the $i^{th}$ line. However, in this embodiment, the polarity is inverted on a scanning line basis, the operation for the horizontal retrace period and the horizontal effective display period in the $(i+1)^{th}$ line corresponds to the operation of writing negative polarity.

Specifically, at the horizontal retrace period immediately before the horizontal effective display period in the $(i+_1)^{th}$ line, the polarity indication signal Po1 changes to level L, so that the voltages of the data signals Vid1 to Vid6 change from the voltage Vb(+) corresponding to positive-polarity black to the voltage Vb (−) corresponding to negative-polarity black. Therefore, when the first control signal Prg1 reaches level H, all the data lines 114 are precharged in the vicinity of the voltage Vb(−) of the data signals Vid1 to Vid6, and then when the second control signal Prg2 reaches level H, all the TFTs 161 are turned on, so that the data lines 114 in the six columns in the same block are short-circuited. Thus, the voltages of the data lines 114 in the six columns in the same block are leveled to the average of the actually precharged voltages for the data lines 114 in the six columns.

Since negative polarity is written during the horizontal effective display period for the $(i+1)^{th}$ line, the inverter circuit 330 inverts the signals distributed and extended to the six channels for the negative-polarity writing with reference to the voltage Vc and outputs them.

While the writing operation for the $i^{th}$ line and the subsequent $(i+1)^{th}$ line have been described, the writing operation is repeated for the first to $864^{th}$ lines during the vertical scanning period (1F).

Thus, if i is an odd number, pixels in odd-number lines are subjected to positive-polarity writing, while pixels in even-number lines are subjected to negative-polarity writing, so that in the vertical scanning period, the writing for all the pixels in the first to $864^{th}$ lines is completed.

During the subsequent vertical scanning period, similar writing operation is executed. At that time, the polarity written to the pixels is interchanged. That is, during the subsequent vertical scanning period, pixels in odd-number lines are subjected to negative-polarity writing, while pixels in even-number lines are subjected to positive-polarity writing.

This interchange of the polarities written to pixels every vertical scanning period prevents application of DC component to the liquid-crystal layers 105, thereby preventing the degradation of the liquid-crystal layers 105.

When all the TFTs 151 are turned on to precharge all the data lines 114 to the voltage Vb(+) or voltage Vb(−) of the data signals supplied via the image signal lines 171, even if the voltages that are actually precharged to the data lines 114 become slightly different because of the difference in the characteristics among the channels, the embodiment enables the last precharge voltages of the data lines 114 in the six columns in the same block to be substantially the same by the short-circuit by the TFTs 161.

Thus, the initial voltages of the data lines 114 are equalized to one another immediately before the data signals Vid1 to Vid6 are sampled in the horizontal effective display period, so that degradation in display quality due to the difference in precharge voltage can be prevented.

FIG. 5 shows an example of the voltages of data lines in block B3. Specifically, when the first control signal Prg1 reaches level H, the data lines 114 are precharged close to a voltage Vb(+) or Vb(−), and when the second control signal Prg2 reaches level H, the voltages are leveled to a voltage Vav(+) or Vav(−). Furthermore, it shows a state in which when, with the leveled voltage held, the sampling signal S3 reaches level H, the voltages change to the sampled voltage (that is, the voltage according to the gray level of a pixel at the intersections between the data line and the selected scanning line, which is indicated by arrow ↑or ↓), and thereafter, and held until the first control signal Prg1 reaches level H again.

In this embodiment, the data lines 114 are precharged at a target voltage Vb(+) or Vb (−) at the point in time when the first control signal Prg1 reaches level H. Therefore, the only reason why the second control signal Prg2 is brought to level H is to short-circuit the data lines 114 precharged at about the voltage Vb(+) or Vb (−) to thereby bring them to the same voltage.

Accordingly, the period T2 in which the second control signal Prg2 reaches level H can be shorter than the period T1 in which the first control signal Prg1 reaches level H. This prevents the disadvantage that the horizontal retrace period is reduced so as to bring the second control signal Prg2 to level H, and allows the size of the TFTs 161 to be smaller than that of the TFTs 151, thus saving the space for the TFTs 161.

In the embodiment, when the first control signal Prg1 reaches level H, the voltage Vb(+) or Vb(−) corresponding to black is applied to the image signal lines 171 as a target precharge voltage. Alternatively, of course, the precharge voltage may be another voltage (corresponding to another color); it may depend on the polarity; or it may be the same voltage for both polarities (e.g., voltage Vc).

In this embodiment, while the first control signal Prg1 and the second control signal Prg2 are exclusively output, it is sufficient to precharge a target voltage for the data lines 114 by turning on the TFTs 151 and to average the precharged voltages among the data lines 114 by the short-circuit of the TFTs 161. Therefore, the first control signal Prg1 and the second control signal Prg2 may be output in a completely duplicated manner or, alternatively, the timing at which the second control signal Prg2 is brought to level L from level H is slightly delayed from the timing at which the first control signal Prg1 becomes level L from level H, as shown in FIG. 6.

Figure 6:
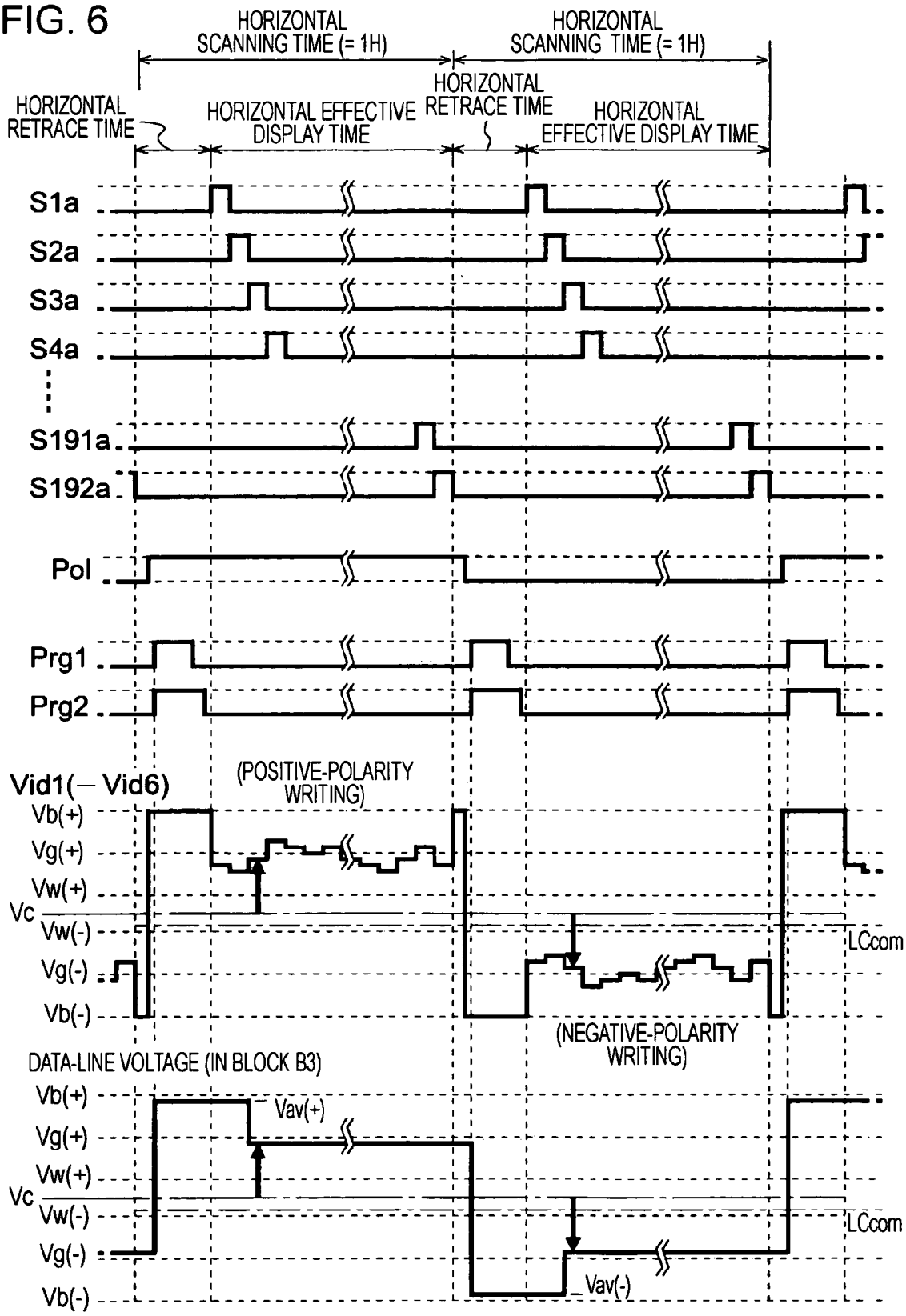
FIG. 6 is a diagram for describing the precharge operation of the electro-optic device.

In either of FIGS. 5 and 6, after the TFTs 151 are turned off, the TFTs 161 are turned off. Accordingly, even if the push-down (also called field-through) of the potential of the data lines 14, which occurs when the TFTs 151 are turned off) varies among data lines, the variations can be equated. This offers the advantage of reducing variations in precharge potential at high accuracy.

Because transistors having a high driving force are sued as the TFTs 151, the push-down of the data-line potential at turn-off is also increased. However, the TFTs 161 may have little influence of push-down when turned off because they may have a driving force lower than that of the TFTs 151, thus offering the above-described advantages.

Figure 7:
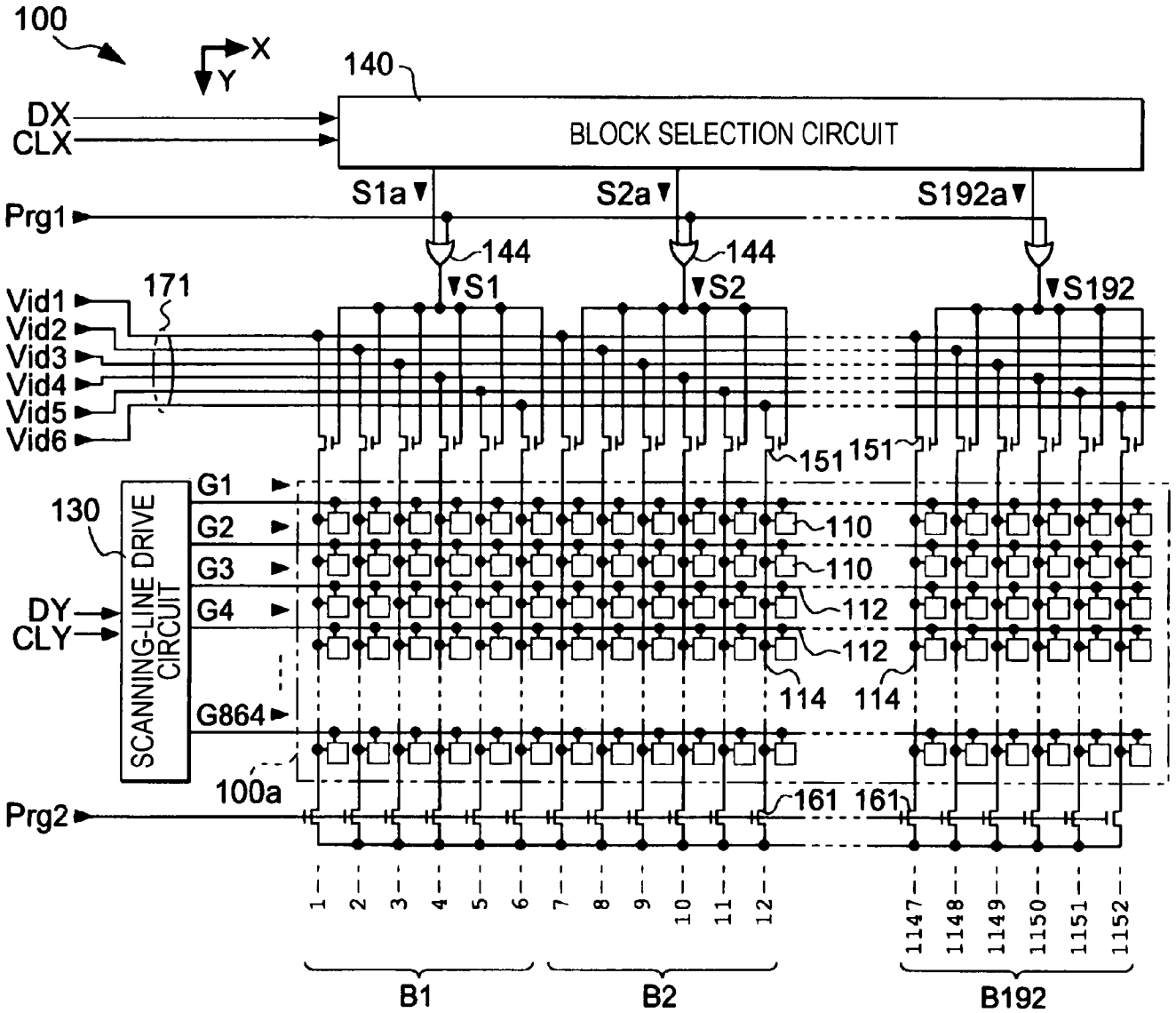
FIG. 7 is a diagram of an application example of the display panel.

In the above embodiment, the data lines 114 in the six columns in the same block are short-circuited by the turn-on of the TFTs 161 so as to mainly cancel the difference in the characteristics of the channels 1 to 6. However, from the viewpoint of leveling the voltages precharged for all data lines 114, it is desirable to short-circuit all the data lines 114 in the first to $1152^{th}$ columns by the turn-on of the TFTs 161, as shown in FIG. 7.

In the embodiment, the number of times of phase expansion by the S/P converter circuit 310 is six, and the number of the image signal lines 171 is also six. Alternatively, the number of times of the phase expansion and the number m of the image signal lines 171 may be an integer equal to or larger than two.

While the processing circuit 50 executes phase expansion by inputting the digital image data Vin, analog image signals may be input for phase expansion. Furthermore, the embodiment is described for a normally white mode in which white is displayed when the effective voltages of the common electrode 108 and the pixel electrode 118 are small. Alternatively, a normally black mode for black display may be employed.

In the embodiment, the TFT 151 is disposed at one end of the data line 114 and the TFT 161 is disposed at the other end of the data line 114. Alternatively, the TFT 151 and the TFT 161 may be disposed at the same end of the data line 114 because the installation space for TFT 161 may be small.

In the embodiment, the voltage LCcom applied to the common electrode 108 is set slightly lower than the voltage Vc that is the reference of polarity inversion, as shown in FIGS.

5 and 6. This is because push-down in which the potential of the drain (pixel electrode 118) is decreased when the TFT is turned off owing to the parasitic capacitor between the gate and drain of the TFT. Specifically, AC driving should be executed in principle for liquid-crystal capacitor to prevent the degradation of the liquid-crystal layer 105. However, if the voltage LCcom is applied with AC as the reference for polarity inversion, the effective voltage of the liquid-crystal capacitor becomes a little larger in negative-polarity writing than in positive-polarity writing owing to the push-down. Accordingly, the voltage LCcom of the common electrode 108 is set slightly lower than the reference voltage Vc for the polarity inversion so as to equalize the effective voltages of the liquid-crystal capacitors to one another even if positive-polarity and negative-polarity writing are executed at the same gray level.

While the embodiment uses TN liquid crystal, another liquid crystal may be used, such as bi-stable twisted nematic (BTN) type having memory ability including a twisted nematic type and a ferroelectric type, a polymer dispersed type, or guest host (GH) type in which an dye (guest) having anisotropy in absorbing visible light along the major axis and minor axis of the molecules is melted in a liquid crystal (host) with a fixed molecular alignment so that the dye molecules and the liquid-crystal molecules are arranged in parallel.

Alternatively, the liquid crystal may have a vertical orientation (homeotropic molecular alignment) in which when no voltage is applied, liquid-crystal molecules are aligned vertically with respect to the substrates, while when voltage is applied, liquid-crystal molecules are aligned horizontally with respect to the substrates, or may have a parallel (horizontal) alignment (homogeneous molecular alignment) in which when no voltage is applied, liquid-crystal molecules are aligned horizontally with respect to the substrates, while when voltage is applied, liquid-crystal molecules are aligned vertically with respect to the substrates. Thus, the invention can be applied to liquid crystals with various alignments.

Furthermore, the invention may be applied not only to a liquid crystal device but also to all structures in which voltages subjected to multiple m-phase expansion are output to m image signal lines 171 and the voltages through the m image data lines are applied to the data lines.

Figure 8:
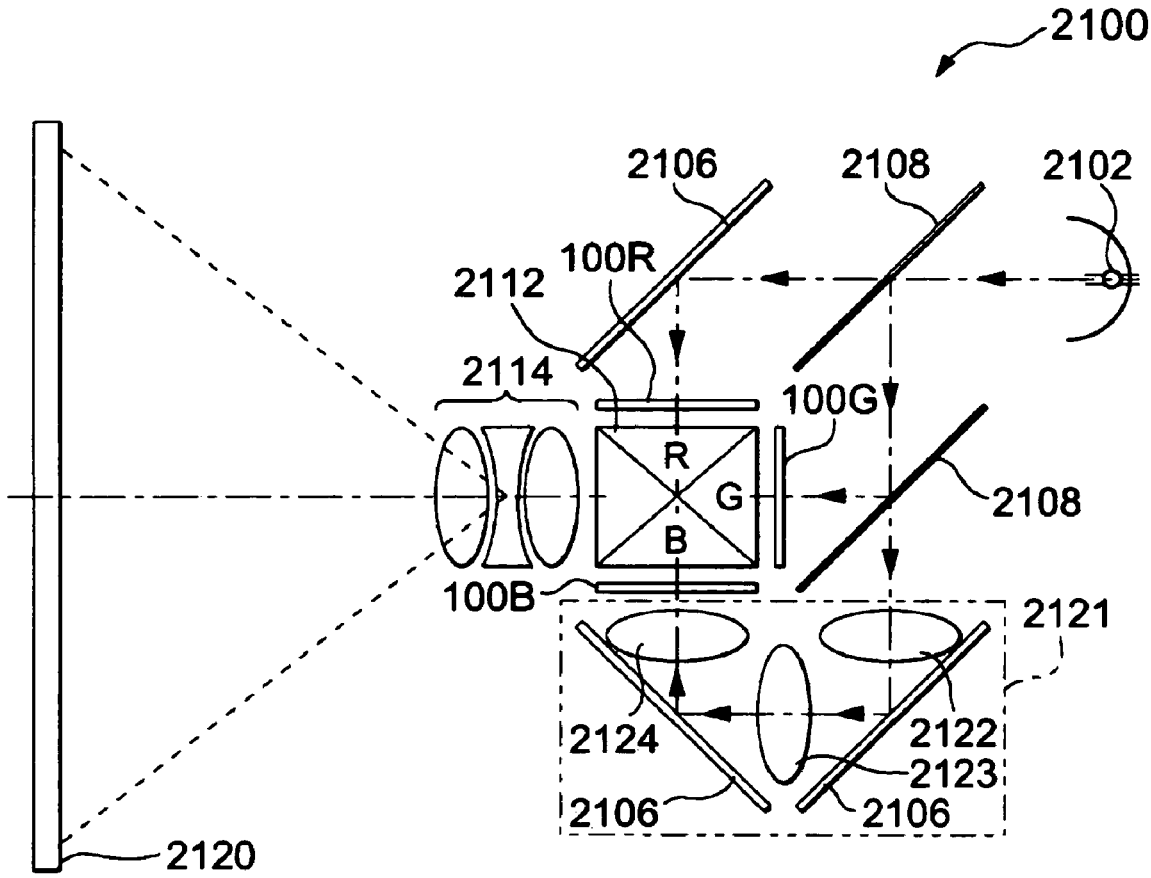
FIG. 8 is a plan view of a projector which is an example of an electronic device incorporating the electro-optic device.

As an example of electric devices including the electro-optic device according to the embodiment, a projector using the display panel 100 as a light valve will be described. FIG. 8 is a plan view of the projector, denoted by numeral 2100. The projector 2100 accommodates a lamp unit 2102 including a white light source such as a halogen lamp. Projection light emitted from the lamp unit 2102 is separated into three primary colors, red (R), green (G), and blue (B) by three mirrors 2106 and two dichroic mirrors 2108 disposed in the projector 2100 and is guided to light valves 100R, 100G, and 100B corresponding to the respective primary colors. Since B-color light has a longer optical path than that of R- and G-color lights, the B-color light is guided through a relay lens system 2121 including an entrance lens 2122, a relay lens 2123, and an output lens 2124.

The arrangement of the light valves 100R, 100G, and 100B is the same as that of the display panel 100 in the foregoing embodiment, which are driven by a image signal corresponding to the R, G, or B color supplied from a processing circuit (not shown in FIG. 8). That is, the projector 2100 has a structure in which the electro-optic device including the display panel 100 is provided for each of R, G, and B colors, three sets in total.

The lights modulated by the light valves 100R, 100G, and 100B are incident on a dichroic prism 2112 from three directions. The R and B lights are refracted at 90 degrees by the dichroic prism 2112, while the G light travels in a straight line. Accordingly, after the images of the colors are combined, a color image is projected onto a screen 2120 through a projection lens 2114.

Since the lights corresponding to the primary colors RGB enter the light valves 100R, 100G, and 100B reflected by the dichroic mirrors 2108, respectively, there is no need to provide a color filter. The images passing through the light valves 100R and 100B are projected after being reflected by the dichroic mirrors 2108, while the image from the light valve 100G is projected as it is. Therefore, the directions of the horizontal scanning by the light valves 100R and 100B are inverted to the direction opposite to the horizontal scanning by the light valve 100G to thereby reverse the right and left.

Electronic devices includes, in addition to that described with reference to FIG. 8, television sets, view-finder and monitor-direct-view-video tape recorders, car navigation systems, pagers, electronic notebook, electronic calculators, word processors, workstations, TV telephones, POS terminals, digital still cameras, mobile phones, and devices having a touch panel. It is needless to say that the electro-optic system according to the embodiment of the invention can be applied to the various electronic devices.

What is claimed is:

1. An electro-optic device comprising:

a plurality of pixels corresponding to a plurality of scanning lines and a plurality of data lines;

a scanning-line drive circuit that selects the scanning lines in a predetermined order;

a block selection circuit that sequentially selects a block including m columns of data lines (m is an integer equal to or larger than 2 and smaller than the total number of the data lines);

m image signal lines to which data signals are supplied and to which precharge signals of a predetermined voltage are supplied before the block is selected, the data signals each having a voltage corresponding to the gray-scale level of a pixel corresponding to a selected scanning line and a data line in a selected block;

a sampling switch provided for each data line, wherein when the data signals are supplied to the m image signal lines, m sampling switches corresponding to the data lines in the block selected by the block selection circuit become conducting to sample the data signals; when the precharge signals are supplied to the m image signal lines, the sampling switches become conducting according to a predetermined control signal to sample the precharge signal on the data lines before the sampling switches sample the data signals; and short-circuiting switches that become conducting according to a predetermined second control signal and short-circuit at least m data lines in the block, after the precharge signals are sampled to the data lines by the precharge switch before the data signals are sampled to the data lines.

2. The electro-optic device according to claim 1, wherein the short-circuiting switch short-circuits all the data lines.

3. The electro-optic device according to claim 1, wherein the sampling switch is disposed at one end of the data line; and the short-circuiting switch is disposed at the other end of the data line.

4. The electro-optic device according to claim 1, wherein the period during which the short-circuiting switch is conducting according to the second control signal is shorter than the period during which the sampling switch is conducting according to the first control signal.

5. The electro-optic device according to claim 1, wherein the timing at which the short-circuiting switch is made to become conducting according to the second control signal is later than the timing at which the sampling switch is made to stop being conducting according to the first control signal.

6. A method for driving an electro-optic device including a plurality of pixels corresponding to a plurality of scanning lines and a plurality of data lines and, when a scanning line is selected, the pixel becoming of a gray level corresponding to the voltage of the data line, the method comprising:

selecting the scanning lines in a predetermined order;

selecting a block including m columns of data lines (m is an integer equal to or larger than 2 and smaller than the total number of the data lines);

supplying data signals of a voltage corresponding to the gray level of a pixel corresponding to a selected scanning line and a data line in a selected block to m image signal lines, and supplying precharge signals of a predetermined voltage before the block is selected;

when the data signals are supplied to the m image signal lines, sampling the data signals on m data lines in the selected block;

when the precharge signals are supplied to the m image signal lines, sampling the precharge signals on the data lines; and short-circuiting at least data lines in the m columns in the block after the precharge signals are sampled on the data lines before the data signals are sampled.

7. An electronic device comprising the electro-optic device according to claim 1.

* * * * *

UNITED STATES PATENT AND TRADEMARK OFFICE

CERTIFICATE OF CORRECTION

PATENT NO. : 7,626,567 B2
APPLICATION NO. : 11/591149
DATED : December 1, 2009
INVENTOR(S) : Toru Aoki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 669 days.

Signed and Sealed this

Second Day of November, 2010

David J. Kappos

David J. Kappos
*Director of the United States Patent and Trademark Office*